US005689901A

United States Patent [19]

Bell et al.

[11] Patent Number: 5,689,901

[45] Date of Patent: Nov. 25, 1997

[54] FOOTWEAR WITH TWO-PIECE SOLE

[75] Inventors: Michael Bell, 1705 Triumphe Way, Warrington, Pa. 18976; Jonathan Bell, Philadelphia, Pa.

[73] Assignee: Michael Bell, Warrington, Pa.

[21] Appl. No.: 601,924

[22] Filed: Feb. 15, 1996

[51] Int. Cl.[6] ..... A43C 15/00; A43C 15/06; A43C 15/02; A43C 15/04

[52] U.S. Cl. ..... 36/7.6; 36/7.5; 36/62; 36/135

[58] Field of Search ..... 36/7.5, 7.6, 135, 36/62

[56] References Cited

U.S. PATENT DOCUMENTS

| | | | |
|---|---|---|---|
| 55,786 | 6/1866 | Schroeder . | |
| D. 80,632 | 3/1930 | Perugia . | |
| 84,267 | 11/1868 | Davis . | |
| 832,987 | 10/1906 | Linwood et al. . | |
| 917,476 | 4/1909 | McCunn . | |
| 1,360,995 | 12/1920 | Anderson . | |
| 1,458,497 | 6/1923 | Perkins | 36/7.6 |
| 1,506,662 | 8/1924 | Peller | 36/7.6 |
| 1,552,946 | 9/1925 | Perkins | 36/7.6 |
| 2,033,313 | 3/1936 | Wilson . | |
| 2,069,752 | 2/1937 | Dorr . | |
| 2,237,652 | 4/1941 | Capezio . | |
| 2,332,252 | 10/1943 | Payne . | |
| 2,362,010 | 11/1944 | Huff . | |
| 2,435,668 | 2/1948 | Behringer et al. . | |
| 2,522,515 | 9/1950 | Hill . | |
| 2,538,182 | 1/1951 | Young | 36/7.6 |
| 2,711,033 | 6/1955 | Dick . | |
| 2,954,617 | 10/1960 | Yamaguchi . | |
| 3,739,501 | 6/1973 | Barrett, Jr. . | |
| 3,742,625 | 7/1973 | Famolare, Jr. . | |
| 4,546,557 | 10/1985 | Barouk et al. . | |

FOREIGN PATENT DOCUMENTS

| | | | |
|---|---|---|---|
| 54745 | 7/1950 | France | 36/7.6 |

*Primary Examiner*—Paul T. Sewell
*Assistant Examiner*—Anthony Stashick
*Attorney, Agent, or Firm*—Caesar, Rivise, Bernstein, Cohen & Pokotilow, Ltd.

[57] ABSTRACT

An ice-gripping attachment device for securement to the sole of primary footwear, e.g., a boot. The attachment device includes comprises a front section, a rear section, and a pair of straps interconnecting the sections. The front section includes a front sole portion having a toe box disposed over it. The rear section includes a rear sole portion and a heel cup disposed over it. The toe box is adapted for accommodating the toe portion of the boot, while the heel cup is arranged for accommodating the heel portion of the boot. The pair of straps interconnect the toe box and the heel cup along the medial and lateral sides of the boot and are located above the front sole portion and the rear sole portion so that they do not contact the ground when attachment device is in place on the boot. The straps are arranged to be releasably secured together by VELCRO® or other hook and loop fasteners and can be extend about the upper of the boot to prevent the rear section of the device from becoming disengaged from the boot. The underside of the sole of the attachment device includes ridges and ice-penetrating projections or studs to provide a non-slip surface.

8 Claims, 3 Drawing Sheets

FIG. 1
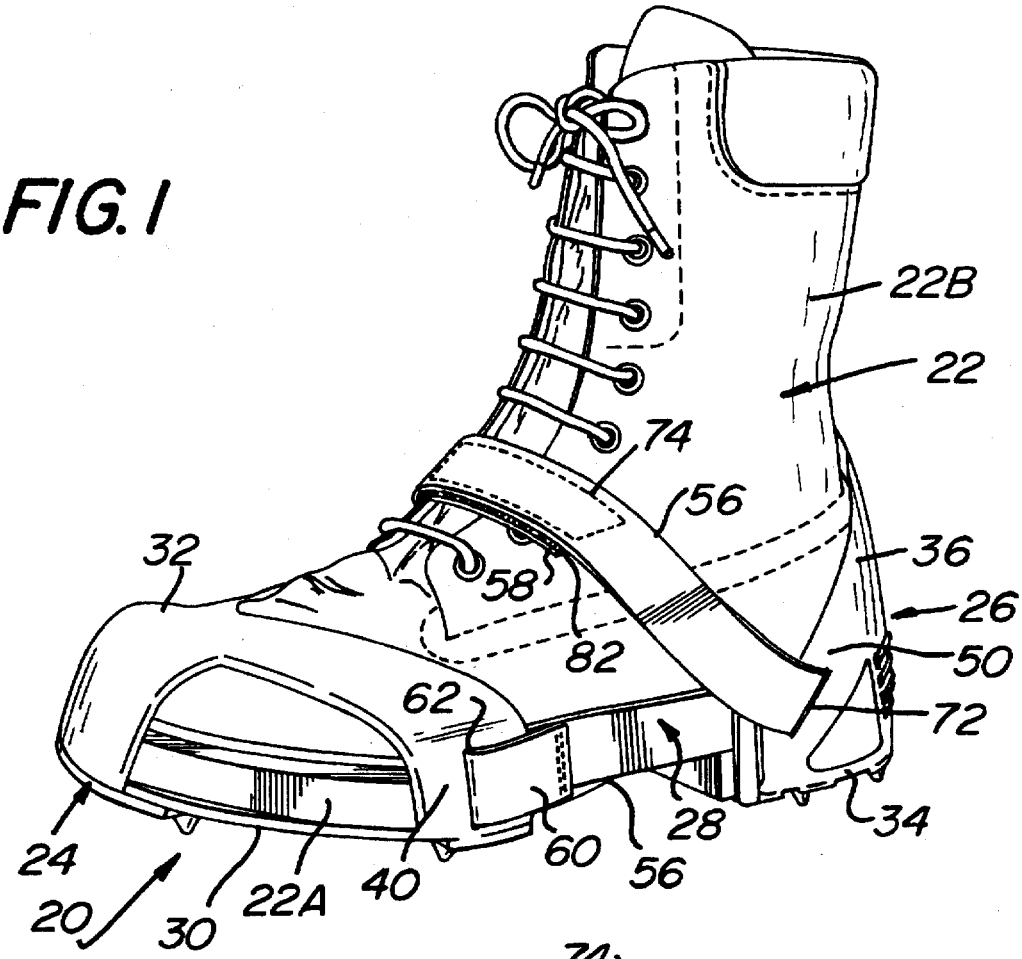
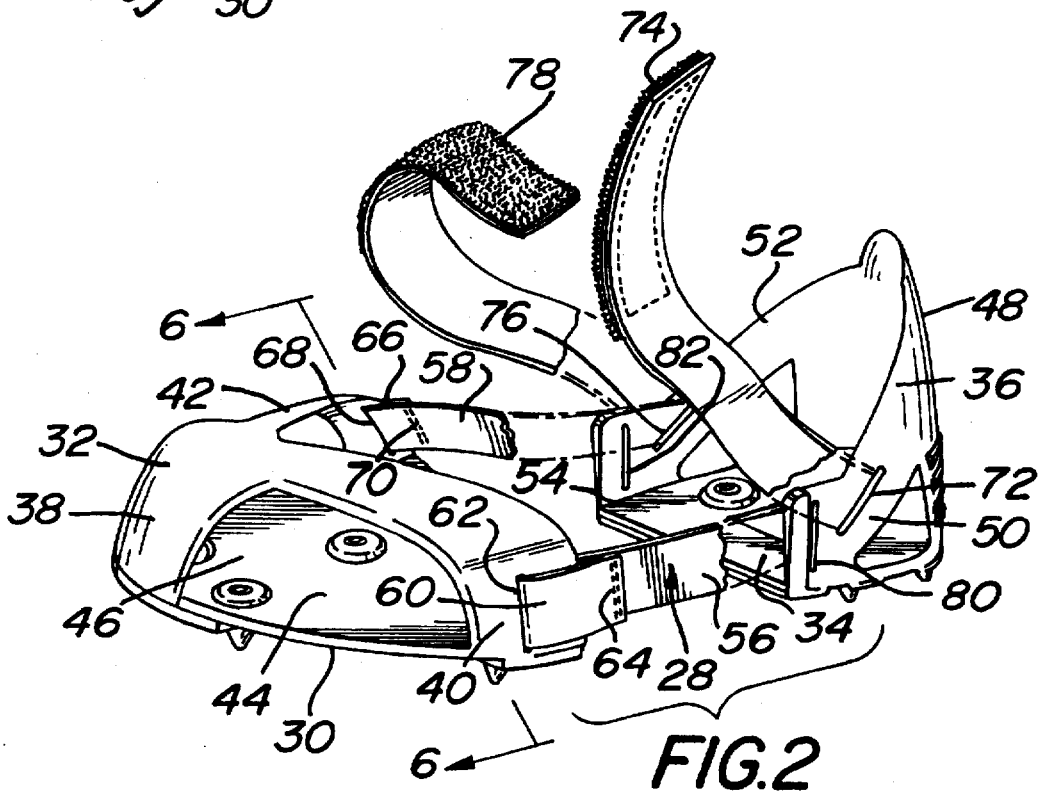
FIG. 2

FOOTWEAR WITH TWO-PIECE SOLE

BACKGROUND OF THE INVENTION

This invention relates generally to footwear, and more particularly to footwear in the form of a sandal-like construction which is adapted to be worn over other footwear to prevent slippage on ice or snow.

Various ice gripping, sandal-like, attachments for footwear are commercially and have been disclosed in the patent literature. Examples of such patented devices are found in the following U.S. Pat. Nos. 1,032,600 (Grout); 2,361,972 (Smith); 3,214,850 (McNair); 3,516,181 (Jordan); 4,344,238 (Peyser); 4,353,172 (Bryant); 4,525,939 (McNeil et al.); and 4,910,883 (Zock, Jr.). While the devices disclosed in those patents appear generally suitable for their intended purposes, they never the less appear to leave something to be desired from various standpoints, such as simplicity of construction, ease of mounting, removing, and effectiveness in preventing slipping.

OBJECTS OF THE INVENTION

Accordingly, it is a general object of this invention to provide a footwear device which overcomes the disadvantages of the prior art.

It is another object of this invention to provide a footwear sole attachment device having a two-piece sole.

It is another object of this invention to provide an attachment which can be easily mounted onto the sole of any type of primary footwear to render that footwear resistant to slippage on ice or snow.

It is yet another object of this invention to provide a footwear attachment device having a two-piece, non-slip sole which is simple in construction and relatively low in cost.

SUMMARY OF THE INVENTION

These and other objects of this invention are achieved by providing a device for use on a primary footwear (or on the foot of a person). The primary footwear (or foot of the person) has a sole, a heel portion and a toe portion, a medial side, and a lateral side. The device of this invention is arranged to render the primary footwear (or the person's foot) resistant to slipping.

The device for use on a primary footwear basically comprises a front section, a rear section, and flexible hinge means interconnecting the sections.

The front section includes a front sole portion and toe box means mounted over the front sole portion. The rear section includes a rear sole portion and heel retention means mounted over the rear sole portion. The toe box means is adapted for accommodating the toe portion of the primary footwear therein. The heel retention means is arranged for accommodating the heel portion of the primary footwear therein, whereupon the sole of the primary footwear is exposed between the front section and the rear section of the attachment device.

The flexible hinge means comprises a pair of straps interconnecting the toe box and the heel retention means along the medial and lateral sides of the primary footwear. The pair of straps are located above the front sole portion and the rear sole portion of the attachment device so that they do not contact the ground when attachment device is in place on the primary footwear.

In accordance with one preferred embodiment of the invention securement means is provided to ensure that the rear section stays in place on the heel portion of the primary footwear. The securement means, in that embodiment, comprises a portion of the straps which form the flexible hinge means. In particular, those portions of the straps are arranged to be extended over a portion of the primary footwear adjacent the instep-ankle interface to releasably secure the rear section to the primary footwear.

DESCRIPTION OF THE DRAWINGS

Other objects and many attendant features of this invention will become readily appreciated as the same becomes better understood by reference to the following detailed description when considered in connection with the accompanying drawings wherein:

FIG. 1 is an isometric view of a footwear sole attachment device constructed in accordance with this invention shown mounted on conventional footwear, e.g., a boot, with a strap of the device shown extending over the instep-ankle area of the boot;

FIG. 2 is an isometric view of the footwear sole attachment device shown in FIG. 1 with the strap shown disconnected;

DETAILED DESCRIPTION OF THE PREFERRED EMBODIMENTS

Figure 3:
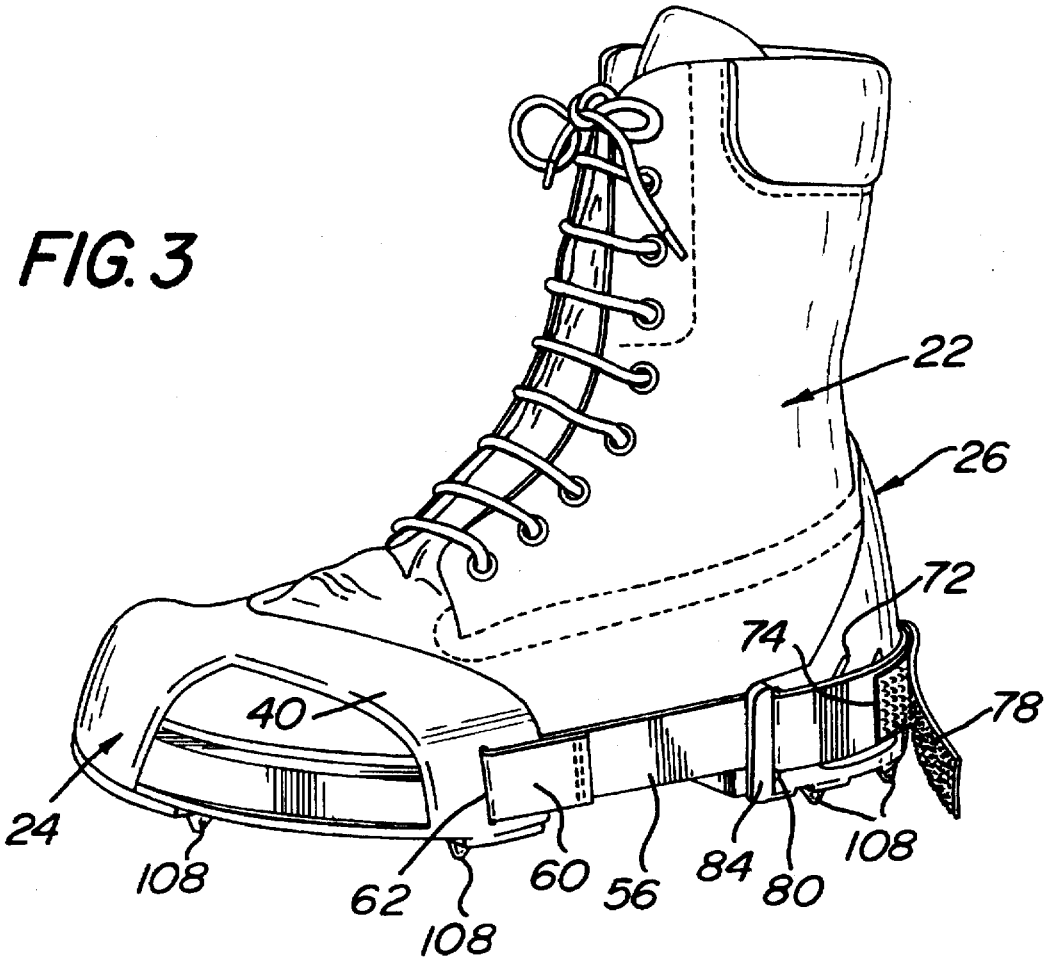
FIG. 3 is an isometric view, similar to FIG. 1 but showing the sole attachment device of FIG. 1 with its strap extending about a portion of the heel area of the boot.

Referring now to various figures of the drawing where like reference numerals refer to like parts there is shown at 20 in FIG. 1, a sole attachment device constructed in accordance with this invention. The sole attachment device 20 is arranged for releasable securement to any type of conventional footwear 22, e.g., a boot, having a sole 22A and an upper 22B, to render that footwear resistant to slippage on slippery surfaces. In accordance with a preferred embodiment of this invention the attachment device 20 is particularly suited for providing slip resistance on snow and ice. To that end the preferred embodiment the attachment device includes plural ice-gripping cleats (to be described later).

As can be seen in FIG. 1 the attachment device 20 basically comprises a front or toe section 24, a rear or heel section 26, and an interconnecting hinge assembly 28. Each section includes a sole and an associated "upper." In particular, the front or toe section 24 includes a sole 30 and an upper in the form of a toe box 32. The rear or heel section 26 includes a sole 34 and an upper in the form of a heel cup 36. Each of the sections 24 and 26 is formed, e.g., molded, as an integral unit of a rugged, yet somewhat flexible material. One particularly effective material is low density polyethylene. Other suitable moldable materials, such vinyl, thermoplastic rubber, etc., can be utilized as well.

The toe box 32 is of a general Y-shape and includes a front web 38 projecting upward from the front tip of the sole 30, and a pair of angularly extending webs 40 and 42 projecting upward from the lateral and medial sides, respectively, of the sole 30 at the rear end thereof and merging with the front web 38. The webs forming the toe box thus extend over the upper surface 44 (FIG. 2) to provide a space 46 arranged to receive the toe portion of the boot as shown in FIG. 1, whereupon the sole 22 of the boot rests on the inner or top surface 44 the front section's sole 30.

The heel cup 36 includes a curved rear wall 48 projecting upward from the rear end of the sole 34 and a pair of angularly extending bracing webs 50 and 52 and projecting upward from the lateral and medial sides, respectively, of the sole 34 at the front end thereof. The bracing webs 50 and 52 merge with the curved rear wall 48 on opposite sides thereof approximately midway up the wall. The bracing webs serve to hold the curved wall in position extending upward from the sole of the rear section. The rear section's sole includes a top surface 54. The curvature of the rear wall 48 is such that it will readily accommodate the heel portion of the boot 22, with the bottom of the boot's heel resting on the top surface 54 of the rear section's sole 34.

The interconnecting hinge assembly 28 basically comprises a pair of flexible straps 56 and 58. Each of the straps includes one end fixedly secured to the toe box of the front section above the sole thereof, and an opposed free end for releasable securement to the heel cup to connect the front and rear sections together. In particular, the strap 56 includes an end 60 which is extended through a generally vertically oriented slot 62 in the web 40 and is formed into a loop. The loop is secured in place by stitch lines 64. In a similar manner the strap 58 includes an end 66 which is extended through a generally vertically oriented slot 68 in the web 42 and is formed into a loop and sewn in place by stitch lines 70.

The free end portions of the straps 56 and 58 extend rearwardly generally parallel to the sole of the attachment device 20 but above it for releasable securement to the heel cup of the rear section 26 to hingedly secure the two sections together and to mount the attachment device 20 on the boot 22. The mounting of the attachment device on the boot can be accomplished on either of two ways, depending upon the orientation of the straps 56 and 58. In particular, in one orientation the free ends of the straps 56 and 58 are extended through angled slots (to be described later) in the heel cup over the boot at the interface of the boot's instep and ankle portions to firmly hold the attachment in place. This arrangement is shown in FIG. 1 and will be described hereinafter. In the other orientation the free ends of the straps 56 and 58 are extended through vertically oriented slots (also to be described later) and around the heel cup as shown in FIG. 3.

Referring now to FIGS. 1 and 2 the first manner of releasable securement of the straps 56 and 58 to the heel cup will now be described. Thus, as best seen in FIG. 2 the free end portion of the strap 56 passes through a generally angularly oriented slot 72 in the bracing web 50 of the heel cup to the inside of the heel cup. From that position the free end of the strap 56 extends generally forwardly at an acute angle towards the front section 24. A strip 74 of a multi-hook component VELCRO® fastening tape is fixedly secured, e.g., sewn, on the inner surface of the strap 56 contiguous with the free end thereof. This strip is arranged to be releasably secured to a cooperating strip of VELCRO® fastening tape on the strap 58 to secure the two straps together and the attachment 20 in place on the boot.

In a similar manner the free end portion of the strap 58 extends rearwardly generally parallel to the attachment's sole but above it for passage through a generally angularly oriented slot 76 in the bracing web 52 of the heel cup to the inside of the heel cup. From that position the free end of the strap 58 extends generally forwardly at an acute angle towards the front section 24. A strip 78 of a multi-loop or plush component of VELCRO® fastening tape is fixedly secured, e.g., sewn, on the inner surface of the strap 58 contiguous with the free end thereof.

When the two straps 56 and 58 are extended through the slots 72 and 76 and oriented like that shown in FIG. 1 they can be releasably connected together, via their VELCRO® strips over the instep-ankle interface of the boot to securely hold the attachment on the boot. Moreover, by pulling the straps 56 and 58 tight before securing them to each other, one can adjust the spacing between the front and rear sections 24 and 26 of the attachment to accommodate any size boot with a single attachment device. The fact that the sections 24 and 26 are only connected by the straps 56 and 58 ensures that the attachment does not interfere with the flexibility of the boot. Further still, with the straps located above the sole of the boot they do not contact the ground where they could become dirty or worn.

Figure 4:
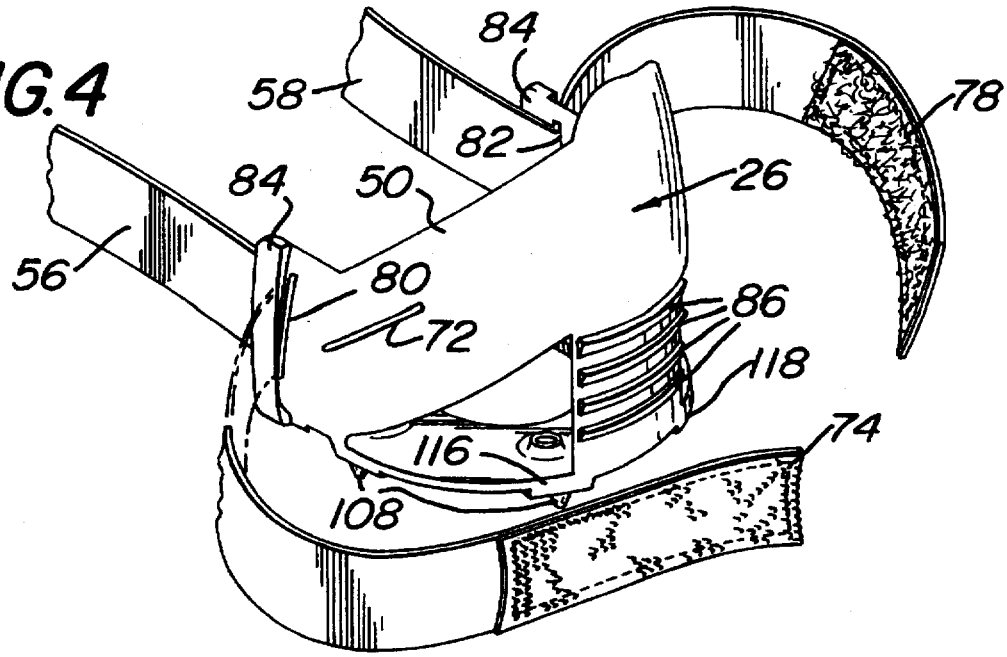
FIG. 4 is an enlarged isometric view of the heel portion of the footwear sole attachment device shown in FIG. 3 with the strap shown disconnected.

Referring now to FIGS. 3 and 4 the second manner of releasable securement of the straps 56 and 58 to the heel cup will now be described. Thus, as can be seen therein the free end portion of the strap 56 passes through a generally vertically oriented slot 80 in the bracing web 50 of the heel cup to the outside of the heel cup. From that position the free end of the strap 56 extends rearwardly around the heel cup for releasable securement to the free end of the strap 58 to secure the two straps together and the attachment 20 in place on the boot. To that end the free end portion of the strap 58 extends rearwardly generally parallel to the attachment's sole but above it for passage through a generally vertically oriented slot 82 (FIG. 4) in the bracing web 52 (FIG. 2) of the heel cup to the outside of the heel cup. From that position the free end of the strap 58 extends rearwardly around the heel cup. The strip 78 of a multi-loop component of VELCRO® fastening tape can then overlap and engage the strip 74 of the multi-hook component to releasably secure them together. By pulling the straps 56 and 58 tight before securing them to each other, one can adjust the spacing between the front and rear sections 24 and 26 of the attachment to accommodate any size boot with a single attachment device. Moreover, by pulling the straps tight before securing them to each other the attachment will be securely mounted on the boot (albeit perhaps less securely than when the straps are oriented over the boot—like shown in FIG. 1). In either case, the fact that the sections 24 and 26 are only connected by the straps 56 and 58 ensures that the attachment does not interfere with the flexibility of the boot. Further still, with the straps located above the sole of the boot they do not contact the ground where they could become dirty or worn.

In order to reinforce the slots 80 and 82 so that the material making up the heel cup does not tear when the straps are pulled tightly therethrough, the portions of the heel cup webs 50 and 52 contiguous with the slots are thickened at 84.

As can be seen clearly in FIG. 4 a plurality of stepped, horizontally disposed ridges 86 (FIG. 4) are provided on the rear outer surface of the heel cup just slightly above the sole. These ridges facilitate the dismounting of the attachment 20 from the boot by providing a surface upon which one can step with the other boot to slide the attachment off of the boot. Moreover, these ridges provide some engagement retention for the portions of the straps 56 and 58 which overlie them when the straps are connected together in the orientation shown in FIG. 3.

Figure 5:
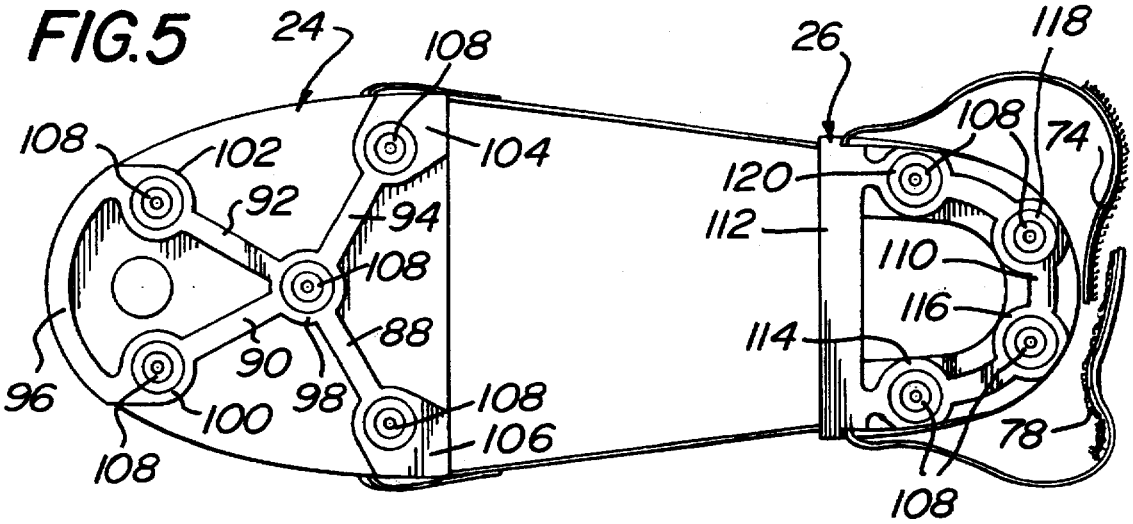
FIG. 5 is a plan view of the underside of the sole of the sole attachment device shown in FIG. 1.
Figure 6:
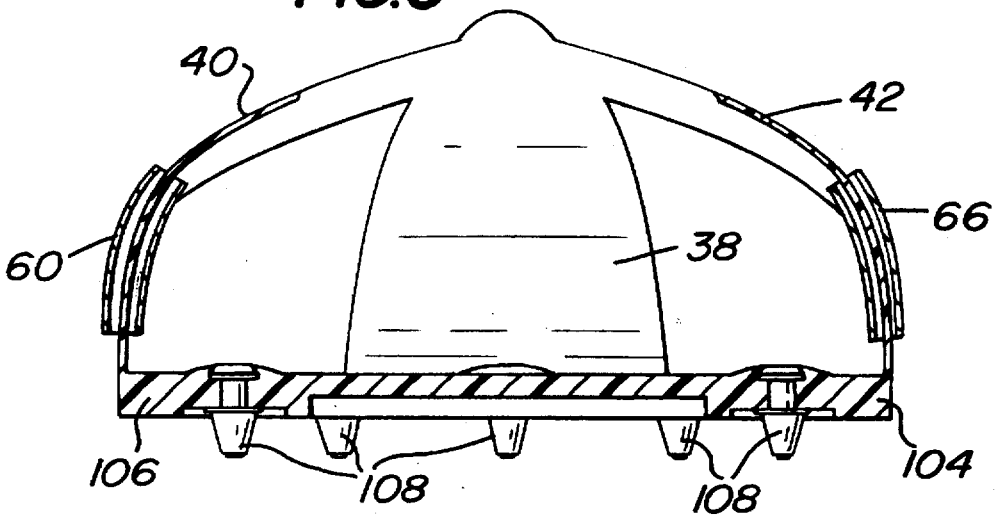
FIG. 6 is an enlarged sectional view taken along line 6—6 of FIG. 2.

In order to provide good non-slip characteristics for the attachment 20, the underside of the attachment's sole includes plural cleats and ice-gripping projections. These cleats and projections are best seen in FIGS. 5 and 6. Thus, as can be seen therein the sole of the front section includes four linear cleats 88, 90, 92, and 94, and one arcuate cleat 96. The arcuate cleat extends along the front edge of the sole of the front section 24. The linear cleats merge together at a central circular mesa 98 from which they project outward radially. The front end of the cleat 90 terminates in a mesa 100 at one end of the arcuate cleat 96, while the front end of the cleat 92 terminates in a mesa 102 at the other end of the arcuate cleat 96. The rear end of the cleat 94 terminates in a mesa 104, while the rear end of the cleat 88 terminates in a mesa 106. Respective prongs or spikes 108 are fixedly mounted in each of the mesas 98, 100, 102, 104, and 106 to project thereout.

The sole of the rear section 26 includes an arcuate cleat 110 and a linear cleat 112. The arcuate cleat extends along the rear edge of the sole of the rear section 26. The linear cleat 112 merges at each end thereof with respective ends of the arcuate cleat 110. A plurality of circular mesas 114, 116, 118, and 120 are located at spaced locations along the arcuate cleat 110. Respective prongs or spikes 108 are fixedly mounted in each of the mesas 114, 116, 118, and 120 to project thereout.

As should be appreciated by those skilled in the art the spikes 108 are arranged for engagement with the surface upon which the wearer of the attachment 20 will walk when the attachment is in place on the boot. Accordingly, when that surface is icy or snowy the spikes will bite into the surface to prevent slippage. In the interests of durability each of the spikes is preferably formed of steel with a carbide tip.

It should be pointed out at this juncture that while the sole attachment device of this invention has particular utility when worn over a primary footwear, such as a boot, it need not be used in that manner. Thus, the device of this invention can be used as primary footwear, i.e., worn directly on the foot or on a sock or stocking without any other primary footwear, for some applications. Further still, the device need not be constructed to include an ice-gripping projections on the bottom surface. Thus, it is contemplated that devices constructed in accordance with this invention can be worn as primary footwear or over primary footwear and can include soles of any type of construction.

Without further elaboration the foregoing will so fully illustrate our invention that others may, by applying current or future knowledge, adapt the same for use under various conditions of service.

We claim:

1. A device for wearing on the foot of a person to render the person resistant to slipping when walking, the person's foot having a sole, a toe portion, a heel portion, an instep portion, a medial side, and a lateral side, said device comprising a front section, a rear section, and flexible hinge means, (a) said front section including a front sole portion and toe box means mounted over said front sole portion, said toe box means being adapted for accommodating therein the toe portion of the person, (b) said rear section including a rear sole portion and heel retention means mounted over said rear sole portion, said heel retention means being arranged for accommodating therein the heel portion of the person, with a portion of the sole of the person between said front section and said rear section being uncovered by said device, said heel retention means including one pair of openings, one of said openings being on the medial side of the person's foot and the other of said openings being on the lateral side of the person's foot, (c) said flexible hinge means comprising first and second straps respectively interconnecting said toe box and said heel retention means along the medial and lateral sides of the person's foot, said first strap being secured to said front section on the medial side of the person's foot and having a free end adapted to be extended through said opening in said heel retention means on the medial side of the person's foot, said other of said straps being secured to said front section on the lateral of the person's foot and having a free end arranged to be extended through said opening in said heel retention means on the lateral side of the person's foot, whereupon said straps extend generally parallel to said sole portions of said front and rear sections between said sections, said free ends of said first and second straps being arranged to be releasably secured together by releasably securable hook and loop fastening means located thereon, said straps being located above said front sole portion and said rear sole portion of said device, whereupon said straps do not contact the ground when said device is in place on the person's foot.

2. The device of claim 1 wherein said front sole portion and said rear sole portion each comprise a non-slip bottom surface.

3. The device of claim 2 wherein said non-slip bottom surface comprises plural ice gripping projections extending therefrom.

4. The footwear attachment device of claim 1 wherein said heel retention means comprises a heel cup in the form of an upstanding wall having a rear portion and wherein said pair of openings are located in said upstanding wall.

5. The device of claim 4 wherein said free ends of said straps are arranged to extend about said rear portion of said upstanding wall of said rear section.

6. The footwear attachment device of claim 5 wherein each of said openings is an elongated slot oriented generally vertically and located in said upstanding wall of said rear section.

7. The device of claim 4 wherein each of said openings is an elongated slot oriented generally at an acute angle to vertical and located in said upstanding wall of said rear section, and wherein the free ends of said straps are arranged to be extended through said openings and over the instep portion of the foot of the person.

8. The footwear attachment device of claim 7 additionally comprising another pair of openings in said heel retention means and wherein said free ends of said straps are arranged to be extended through either said other pair of openings and over the instep portion of the person or through said one pair of openings and around said rear portion of said upstanding wall of said rear section.

* * * * *